US005392624A

United States Patent [19]

Properzi

[11] Patent Number: 5,392,624

[45] Date of Patent: Feb. 28, 1995

[54] PROCESS AND UNIT FOR ROLLING METAL TO PRODUCE A ROUND BAR OR WIRE ROD FROM A ROUND BAR OR WIRE ROD HAVING A LARGER DIAMETER

[76] Inventor: Giulio Properzi, Via P. Cossa, 1-20122 Milan, Italy

[21] Appl. No.: 980,036

[22] Filed: Nov. 23, 1992

[30] Foreign Application Priority Data

Dec. 4, 1991 [IT] Italy ..... MI91 A 003244

[51] Int. Cl.[6] ..... B21B 13/12; B21B 1/18

[52] U.S. Cl. ..... 72/14; 72/235; 72/366.2

[58] Field of Search ..... 72/14, 15, 224, 234, 72/235, 366.2, 240, 248, 251

[56] References Cited

U.S. PATENT DOCUMENTS

| | | | |
|---|---|---|---|
| 1,193,001 | 8/1916 | Edwards | 72/235 |
| 2,357,058 | 8/1944 | Ramsay | 72/221 |
| 4,182,147 | 1/1980 | Brauer et al. | 72/224 |
| 4,283,930 | 8/1981 | Hasegawa et al. | 72/240 |
| 5,000,023 | 3/1991 | Feldmann et al. | 72/245 |
| 5,125,251 | 6/1992 | Pettersson et al. | 72/15 |

FOREIGN PATENT DOCUMENTS

| | | | |
|---|---|---|---|
| 2403119 | 4/1979 | France . | |
| 91533 | 2/1895 | Germany . | |
| 2025640 | 12/1970 | Germany . | |
| 0207502 | 3/1984 | Germany | 72/235 |
| 0135707 | 8/1983 | Japan | 72/235 |
| 61-150703 | 7/1986 | Japan . | |
| 61-159217 | 7/1986 | Japan . | |
| 0232011 | 10/1986 | Japan | 72/14 |
| 0224403 | 10/1987 | Japan | 72/235 |
| 0268501 | 11/1988 | Japan | 72/235 |
| 0027704 | 1/1989 | Japan | 72/235 |
| 1407605 | 7/1988 | U.S.S.R. | 72/234 |

OTHER PUBLICATIONS

Patent Abstracts of Japan, vol. 10, No. 353 (M-539) 28 Nov., 1986 (Keiichiro Yoshida).

Patent Abstracts of Japan, vol. 10, No. 365 (M-542) 6 Dec., 1986 (Asahi Chem Ind).

Draht vol. 33, No. 5, May 1982, Bamberg DE, pp. 237-242 P. Funke.

*Primary Examiner*—Lowell A. Larson

*Assistant Examiner*—Thomas C. Schoeffler

*Attorney, Agent, or Firm*—Guido Modiano; Albert Josif; Daniel O'Byrne

[57] ABSTRACT

A process and unit for hot- and cold-rolling ferrous and non-ferrous metals in order to produce a round bar or wire rod from a round bar or wire rod having a larger diameter. The process consists in inserting a bar or wire rod, whose initial profile has a round cross-section, in a rolling unit which is provided with rolling rolls whose profiles define a round passage whose diameter is smaller than the diameter of the input bar or wire rod. Upstream from the rolling unit, the larger-diameter bar or wire rod is subjected to the action of free rollers whose profiles are suitable to deform the larger-diameter bar or wire rod according to a shape which produces, in output from the rolling unit, a bar or wire rod whose cross-section is round and has a smaller diameter.

9 Claims, 3 Drawing Sheets

PROCESS AND UNIT FOR ROLLING METAL TO PRODUCE A ROUND BAR OR WIRE ROD FROM A ROUND BAR OR WIRE ROD HAVING A LARGER DIAMETER

BACKGROUND OF THE INVENTION

The present invention relates to a process and a unit for the hot- and cold-rolling of ferrous and non-ferrous metals for the manufacture of a round bar or wire rod from a bar or round wire rod having a larger diameter.

As is known, metal rolling generally uses rolling mills which comprise a plurality of stands or rolling units arranged in a line in order to progressively reduce the diameter of the bar in input.

It is furthermore known that on a rolling stand it is practically impossible to obtain a bar with a round profile directly from a round-profile bar having a larger diameter. More precisely, if one feeds a round-profile bar to a rolling stand which has rolls shaped so as to provide a round profile, the output result is not a bar with a round profile but a lobed-profile bar which is not acceptable for the market.

Due to this reason, in a rolling line with rolling units having rolls shaped so as to generate a round profile, one alternates rolling units having rolls shaped so as to generate a non-round intermediate profile which is studied so that during the subsequent passage through a rolling unit with round-profile rolls one actually obtains a round-profile bar which can be accepted by the market.

Currently, in order to obtain rolled products with a round profile, rolling mills of two types are mainly used: rolling mills with two-roll stands and rolling mills with three-roll stands.

In rolling mills with two-roll stands, stands with two rolls shaped so as to provide a round profile are generally alternated with stands with two rolls shaped so as to provide an oval profile. FIGS. 2 to 5 illustrate the sequence of the cross-sections of an initially round bar (FIG. 1) in output from the various rolling stands in rolling mills of this type.

In rolling mills with three-roll stands, stands with three rolls which are arranged so that their axes define the sides of an equilateral triangle and are shaped so as to provide a round profile are alternated with stands with three rolls which are arranged in a similar manner and have a cylindrical skirt in order to define a profile having an almost triangular cross-section. FIGS. 7 to 10 illustrate the sequence of the cross-sections of an initially round bar (FIG. 6) in output from the various rolling stands in rolling mills of this type.

In any kind of rolling mill, the rolls of the various rolling stands are actuated so that they rotate about their axes by means of one motor for each stand, or by means of a single motor which, by means of a speed reduction unit, actuates the rolls of the various stands so that the rotation rate of the rolls complies with the well-known laws of constant rates of metal flow in the various rolling stands which cooperate to deform the bar starting from its entry in the rolling stands up to its exit.

The use of these rolling stands shows problems particularly when it is necessary to pass from the production of bars of a certain diameter to bars having a different diameter.

In this case, in fact, with conventional rolling stands it is necessary to replace the sets of two or three rolls of the two final rolling units and of their guides and adapt the rotation rates of the rolls, for example by replacing some components of the reduction unit which is connected to the rolls or by means of electric adjustments. These operations entail relatively long rolling stand downtimes which make it economically unprofitable to perform small-scale production of profiles whose diameter differs from the "standard" diameters which can be obtained in output from the rolling stands usually used.

SUMMARY OF THE INVENTION

The aim of the present invention is to solve the problem described above by providing a rolling process which allows to obtain greater flexibility for rolling facilities, allowing production changes which can be performed in reduced times.

Within the scope of this aim, an object of the invention is to provide a rolling process which makes it economically profitable to produce even small series of round-profile bars whose diameters differ from the "standard" ones, so as to meet practically all the demands of the market.

Another object of the invention is to provide a rolling unit which is simple to manufacture for carrying out the process according to the invention.

This aim, these objects and others which will become apparent hereinafter are achieved by a process for rolling metals to produce a round bar or wire rod from a round bar or wire rod having a larger diameter, characterized in that it consists in inserting a bar or wire rod whose initial profile has a round cross-section in a rolling unit provided with rolling rolls whose profiles define a round passage whose diameter is smaller than the diameter of the input bar or wire rod, and immediately thereafter making free rolls act on said larger-diameter bar or wire rod, upstream from said rolling unit, said free rolls having profiles suitable to deform the larger-diameter bar or wire rod to a particular shape which produces, at the output of said rolling unit, a bar or wire rod having a smaller-diameter round cross-section.

In order to perform the process according to the invention it is possible to advantageously use a rolling unit which comprises at least two motorized rolling rolls which can be actuated so as to rotate about their axes and can engage a bar for rolling it and pushing it along an advancement direction, said rolls having a shape which is suitable to provide, at the output, a bar whose final profile has a round cross-section, characterized in that it comprises, upstream from said rolling rolls, along the bar advancement direction, adjustable free rollers which can engage said bar and have a shape suitable to provide a predeformation of said bar from an initial profile with round cross-section to an intermediate profile with a non-round cross-section.

BRIEF DESCRIPTION OF THE DRAWINGS

Further characteristics and advantages of the process and unit according to the present invention will become apparent from the description of a preferred but not exclusive embodiment of the process according to the invention and of the rolling unit for performing it, which are illustrated only by way of non-limitative example in the accompanying drawings, wherein.

DESCRIPTION OF THE PREFERRED EMBODIMENTS

Figure 1:
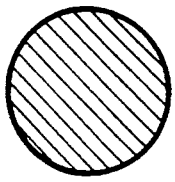
FIG. 1 PRIOR ART
FIGS. 1 to 5 and 6 to 10 show, as mentioned, the rolling sequences in a known rolling mill with two-roll stands and in a rolling mill with three-roll stands.
Figure 2:
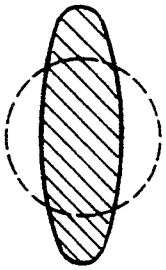
FIG. 2 PRIOR ART
Figure 3:
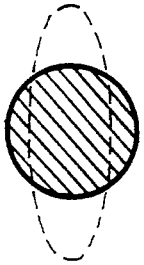
FIG. 3 PRIOR ART
Figure 4:
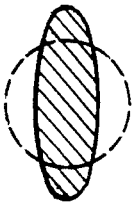
FIG. 4 PRIOR ART
Figure 5:
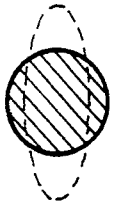
FIG. 5 PRIOR ART
Figure 6:
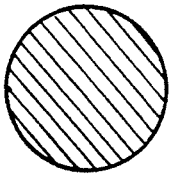
FIG. 6 PRIOR ART
Figure 7:
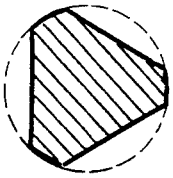
FIG. 7 PRIOR ART
Figure 8:
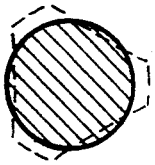
FIG. 8 PRIOR ART
Figure 9:
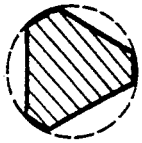
FIG. 9 PRIOR ART
Figure 10:
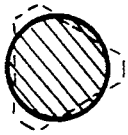
FIG. 10 PRIOR ART

With reference to FIGS. 11 to 17, the rolling unit for performing the process according to the invention, generally designated by the reference numeral 1, comprises, in the illustrated embodiment, a pair of rolling rolls 3 and 4 which can be actuated so as to rotate about their axes 3*a* and 4*a*, which are mutually parallel, in order to roll a bar 5 and make it advance along an advancement direction 6.

The rolling rolls 3 and 4 have, on their skirt, a circumferential concavity 3*b* and 4*b* which is shaped so as to obtain, in output, a bar whose profile has a round cross-section.

The rolling rolls 3 and 4 can be actuated in a known manner by means of an independent gearmotor or by means of a reduction unit with interchangeable gears which is connected to a motor which also actuates other conventional rolling units.

According to the invention, free rollers 7 and 8 are provided upstream from the rolling rolls 3 and 4 along the advancement direction 6, can engage the bar 5 in sequence with respect to the rolls 3 and 4 and have such a shape as to pre-deform the bar 5 from an initial profile with a round cross-section to an intermediate profile with a non-round cross-section.

In the illustrated embodiment, which relates to a two-roll rolling unit, the free rollers are constituted by a pair of rollers 7 and 8 which are arranged mutually opposite and so that their axes 7*a* and 8*a* are mutually parallel but angularly offset substantially by 90° about the axis 5*a* of the bar 5 with respect to the axes 3*a* and 4*a* of the motorized rollers 3 and 4.

Figure 16:
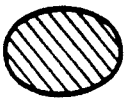
FIG. 16 is a view of the shape of the bar in output from the free rollers.
Figure 17:
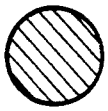
FIG. 17 is a view of the shape of the bar in output from the rolling unit in the steady-state condition.
Figure 11:
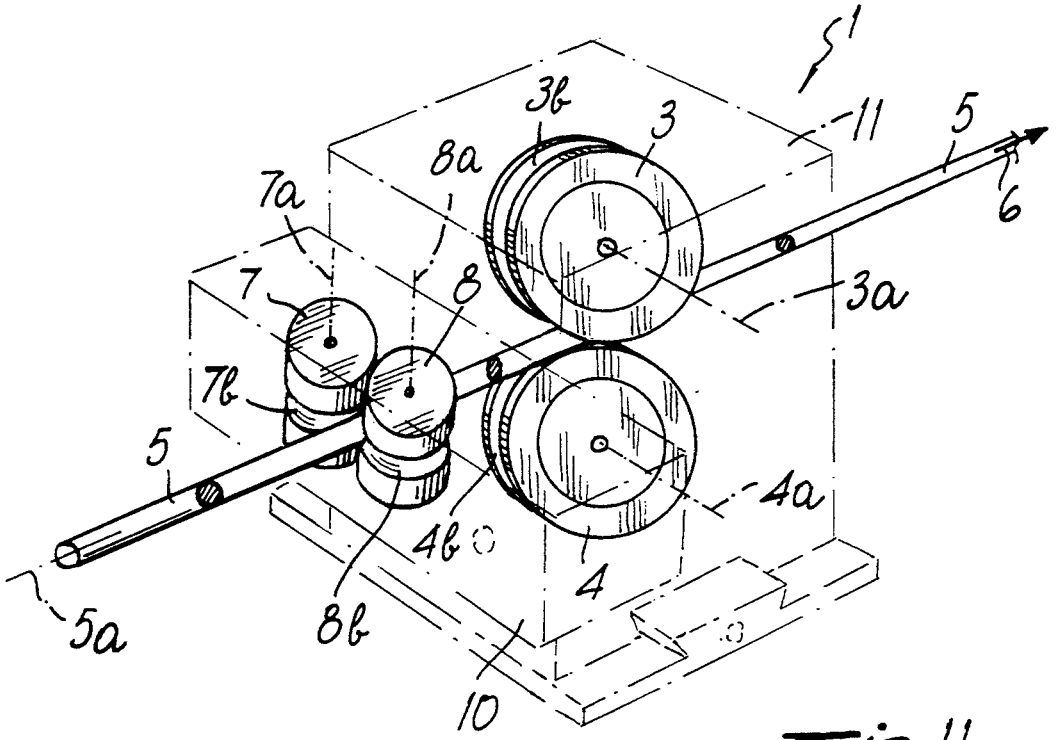
FIG. 11 is a schematic view of a rolling unit for performing the process according to the invention.
Figure 12:
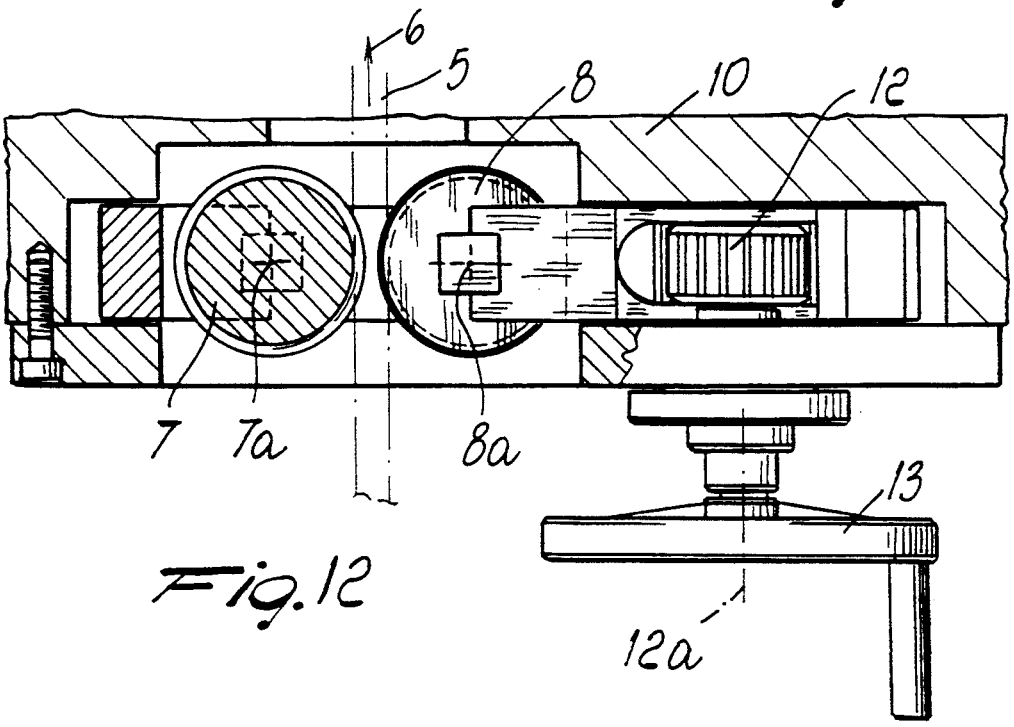
FIG. 12 is a partially sectional top plan view of the free rollers.

The free rollers 7 and 8 have, on their skirt, a circumferential concavity 7*b* and 8*b* which is shaped so as to obtain, at the output from said rollers, a bar which has an intermediate profile with an oval cross-section, as shown in FIG. 16.

Figure 13:
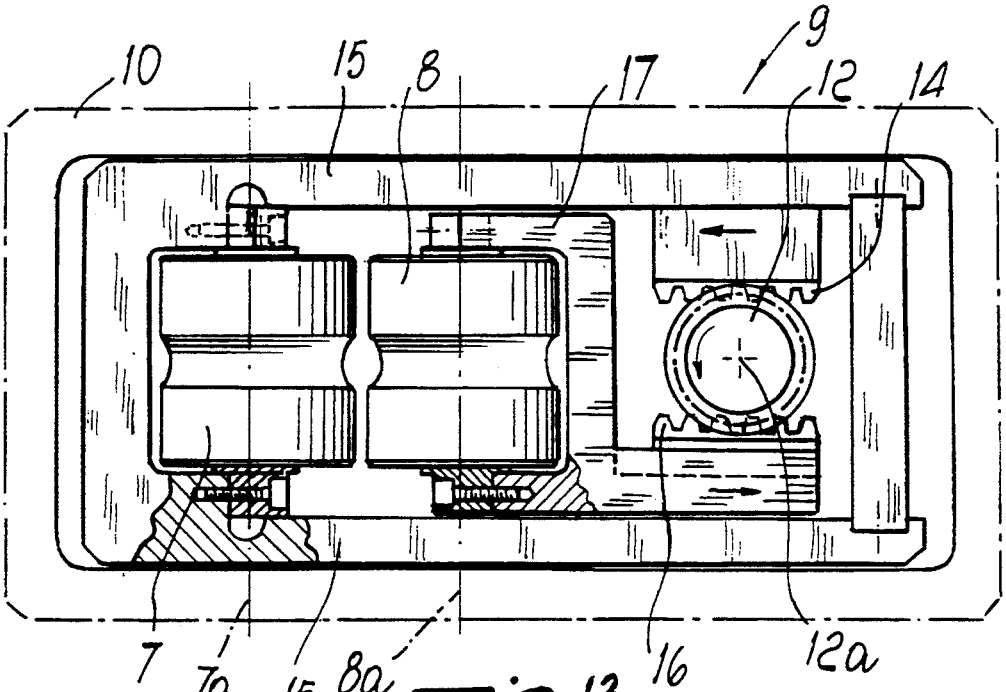
FIGS. 13 and 14 are partially sectional front views of the free rollers in two operating positions.
Figure 14:
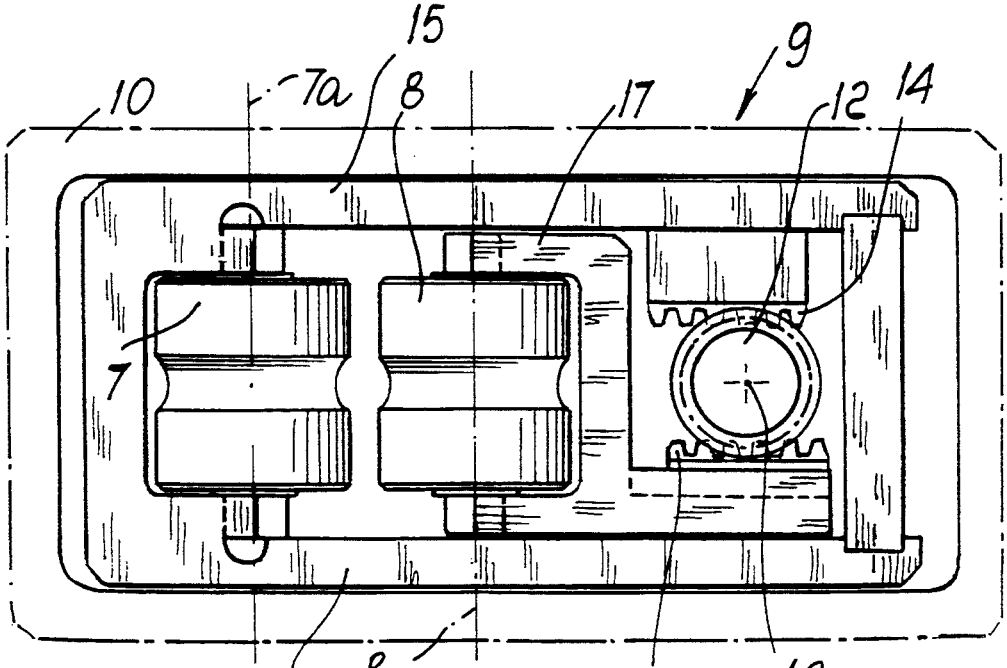

Conveniently, actuation and control means, generally designated by the reference numeral 9 in FIGS. 13 and 14, are provided in order to move the free rollers 7 and 8 closer to, or further away from, the axis 5*a* of the bar 5.

More particularly, the free rollers 7 and 8 are mounted in a fixed structure 10 which is associated with the supporting structure 11 of the rollers 3 and 4. The actuation means comprise a gearwheel 12 which is supported by the fixed structure 10 so that it can rotate about its axis 12*a* arranged parallel to the axis 5*a* of the bar 5, and can be actuated so as to rotate about its axis by means of an actuation handwheel 13.

The gearwheel 12 meshes, in two diametrically opposite regions, respectively with a first rack 14, which is rigidly associated with a first frame 15 which supports the roller 7 so that it can rotate about its axis 7*a*, and with a second rack 16, which is rigidly associated with a second frame 17 which supports the roller 8 in a similar manner. The frames 15 and 17 can slide, with respect to the fixed structure 10, in a plane which is perpendicular to the axis 5*a* of the bar 5, so that the rotation of the gearwheel 12 causes the sliding of the frames 15 and 17 in opposite directions, with the consequent approach or spacing of the rollers 7 and 8 with respect to the axis 5*a*.

The rolling unit for performing the process according to the invention is intended to constitute a finishing unit to be arranged at the output of conventional rolling stands so as to allow to produce bars having a profile with round cross-section whose diameter differs from the "standard" diameters, so as to fully meet the demands of the market.

The operation of the rolling unit in the execution of the process according to the invention is as follows.

Initially, the free rollers 7 and 8 are mutually spaced so as to allow the free passage of the initial portion of the bar 5 until it engages the rolling rolls 3 and 4. After the rolling rolls 3 and 4 have engaged the bar 5, causing its advancement and obtaining the profile of FIG. 15, the free rollers 7 and 8 are moved closer to the axis 5*a* of the bar until they reach the correct position, which is determined according to the practice and theory of rolling. When it exits from the free rollers 7 and 8, the bar 5 has a profile with an oval cross-section (FIG. 16) and, by passing through the rolling rolls 3 and 4, exits from the rolling unit with a profile having a round cross-section (FIG. 17) whose diameter is reduced with respect to the initial profile with round cross-section.

Figure 15:
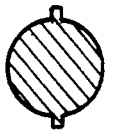
FIG. 15 is a view of the shape of the bar in output from the rolling unit according to the present invention during the startup of said unit.

The initial portion of the bar which has not undergone pre-deformation by the rollers 7 and 8 has the shape shown in FIG. 15 and is meant to be discarded.

The remaining part of the bar has the required profile with round cross-section, since the free rollers 7 and 8 deform the bar so as to re-establish equal rates of flow, preventing the forming of lobes, and so as to allow to produce a round bar within the limits of commercial tolerances.

If one wishes to vary the diameter of the bar in output from the rolling unit, it is sufficient to change the rolling rolls 3 and 4, the free rollers 7 and 8, and to adjust the rotation rate of the rolling rolls alone, with a reduced waste of time.

In practice it has been observed that the process according to the invention fully achieves the intended aim, since it significantly improves production flexibility of rolling facilities, reducing downtimes required for changes in production diameters.

For the sake of simplicity, the process and the rolling unit for its execution have been described with reference to a pair of free rollers and to a pair of rolling rolls; however, it is also possible to provide rolling units for carrying out the process according to the invention with three free rollers and three rolling rolls arranged so that their axes define the sides of an equilateral triangle. In this case, the free rollers can have a cylindrical skirt in order to obtain a bar with a substantially triangular intermediate profile and the rolling rolls have a skirt with a circumferential recess in order to equally obtain a bar with a final profile having a round cross-section.

Also according to the concept underlying the present invention, it is possible to provide an even larger number of free rollers and rolling rolls, according to the requirements.

The process and the rolling unit thus conceived are susceptible to numerous modifications and variations, all of which are within the scope of the inventive concept; all the details may furthermore be replaced with technically equivalent elements.

In practice, the materials employed, as well as the dimensions, may be any according to the requirements and the state of the art.

I claim:

1. In combination, a bar having a bar axis and a standard size diameter and exiting from a conventional rolling mill, and a rolling unit for reducing said diameter of said bar, said rolling unit comprising;

at least two rolling rolls defining a circumferential profile, said circumferential profile delimiting a round passage, said round passage having a diameter smaller than said standard size diameter of said bar;

means for rotating said rolling rolls for engaging said bar exiting from said rolling mill and for axially moving said bar along an advancement direction;

at least two free rollers located upstream of said rolling rolls with respect to said advancement direction;

actuation and control means for moving said free rollers substantially perpendicularly towards said bar axis immediately after said bar is engaged by said rolling rolls, and;

a circumferential concavity provided on each of said free rollers for imparting to said bar an intermediate oval cross-section profile;

whereby to produce in output at said rolling rolls, a bar having a diameter smaller than said standard size diameter, wherein said means for moving said free rollers substantially perpendicularly towards said bar axis comprise actuation and control means, said actuation and control means comprising;

a fixed structure;

first frame means rotatably supporting one of said free rollers and movable with respect to said fixed structure in a first direction extending towards said bar axis;

second frame means rotatably supporting another one of said free rollers and movable with respect to said fixed structure in second direction extending towards said bar axis, and;

means for generating simultaneous relative movement between said first frame means and said second frame means.

2. In combination, a unit for hot and cold rolling ferrous and non-ferrous metals and a bar to be rolled, said bar having a bar axis, said unit comprising;

at least two rolling rolls engageable with said bar and having rolling roll axes;

means for rotating said rolls about said rolling roll axes and advancing said bar along an advancement direction;

a profile defined by each of said rolling rolls for imparting to said bar a round cross-section;

free rollers located upstream of said rolling rolls with respect to said advancement direction and engaging said bar, said free rollers located opposite each other and having free roller axes, said free roller axes being mutually parallel and angularly offset about said bar axis with respect to said rolling roll axes;

a circumferential concavity defined by each of said free rollers, said circumferential concavity imparting to said bar an intermediate oval cross-section profile, and;

actuation and control means for moving said free rollers toward or away from said bar axis and comprising;

a fixed structure;

a gearwheel rotatably supported by said fixed structure and having a gearwheel axis, said gearwheel axis being parallel to said advancement direction;

a first movable frame supporting one of said free rollers;

a first rack fixed to said first movable frame, said first rack being slideably supported by said fixed structure and engaging said gearwheel;

a second movable frame supporting another one of said free rollers, and;

a second rack fixed to said second movable frame, said second rack being slideably supported by said fixed structure and engaging said gearwheel diametrically opposite to said first rack.

3. Rolling unit for reducing the diameter of a bar having a standard size diameter, a bar axis and exiting from a conventional rolling mill, said unit comprising;

at least two rolling rolls defining a circumferential profile, said circumferential profile delimiting a round passage, said round passage having a diameter smaller than said standard size diameter;

means for rotating said rolling rolls for engaging a bar exiting from a rolling mill and for axially moving said bar along an advancement direction;

at least two free rollers located upstream of said rolling rolls with respect to said advancement direction;

means for moving said free rollers towards said bar in a direction substantially perpendicular to said bar axis immediately after said bar is engaged by said rolling rolls, and;

a circumferential concavity provided on each of said free rollers for imparting to said bar an intermediate oval cross-section profile;

whereby to produce in output at said rolling rolls, a bar having a diameter smaller than said standard size diameter, wherein said means for moving said free rollers substantially perpendicularly towards said bar axis comprise actuation and control means, said actuation and control means comprising;

a fixed structure;

gearwheel means rotatably connected to said fixed structure;

actuation means connected to said gearwheel means;

first rack means slideably connected to said fixed structure, rotatably supporting one of said free rollers and engaging said gearwheel means in mesh engagement therewith;

second rack means slideably connected to said fixed structure, rotatably supporting another one of said free rollers and engaging said gearwheel means in mesh engagement therewith diametrically opposite to said first rack means.

4. Rolling unit according to claim 3, wherein said actuation means comprises an actuation handwheel.

5. Rolling unit according to claim 3, wherein said first rack means comprises a first frame rotatably supporting said one of said free rollers, and a first rack connected to said first frame, and wherein said second rack means comprises a second frame rotatably supporting said other one of said free rollers, and a second rack connected to said second frame.

6. Rolling unit according to claim 3, wherein said first rack means comprises a first frame rotatably supporting said one of said free rollers, and a first rack connected to said first frame, wherein said second rack means comprises a second frame rotatably supporting said other one of said free rollers, and a second rack connected to said second frame, and wherein said first frame and said second frame are slideable with respect to said fixed structure in a plane perpendicular to said bar axis.

7. Rolling unit according to claim 3, wherein said free rollers have mutually parallel free roller axes, said roller rolls have mutually parallel roller roll axes, and said gearwheel means define a gearwheel axis, said free roller axes being angularly offset by 90 degrees about said bar axis with respect to said roller roll axes, said gearwheel axis being parallel to said roller roll axes and perpendicular to said free rollers.

8. Process for reducing a bar, having a standard size diameter and exiting from a conventional rolling mill, to a smaller size diameter, said method comprising the steps of;

providing a rolling unit including at least two rolling rolls, said rolling rolls defining a profile with a round passage having a diameter smaller than said standard size diameter;

rotating said rolling rolls so as to engage said bar exiting from said rolling mill and to move said bar along an advancement direction;

providing upstream of said rolling rolls with respect to said advancement direction at least two free rollers;

providing on each of said free rollers a circumferential concavity;

moving said free rollers towards said bar immediately after said bar is engaged by said rolling rolls for imparting to said bar an intermediate oval cross-section profile whereby to produce in output at said rolling rolls, a bar having a diameter smaller than said standard size diameter, wherein said step of moving said free rollers comprises;

providing rack means connected to each of said free rollers;

providing gearwheel means having a gearwheel axis and engaging said gearwheel means in mesh engagement with said rack means;

providing handwheel means connected to said gearwheel means, and;

actuating said handwheel means to move said rack means and said free rollers with respect to said gearwheel means and towards said bar immediately after said bar is engaged by said rolling rolls.

9. Process according to claim 8, further comprising the step of arranging said gearwheel axis parallel to said advancement direction.

* * * * *